US009587342B2

(12) United States Patent
Janke et al.

(10) Patent No.: US 9,587,342 B2
(45) **Date of Patent: *Mar. 7, 2017**

(54) METHOD FOR DETECTING SATELLIZATION SPEED OF CLOTHES LOAD IN A HORIZONTAL AXIS LAUNDRY TREATING APPLIANCE

(71) Applicant: WHIRLPOOL CORPORATION, Benton Harbor, MI (US)

(72) Inventors: Brian P. Janke, Saint Joseph, MI (US); Peter J. Richmond, Berrien Springs, MI (US); Peter E. Zasowski, Yantis, TX (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/831,899

(22) Filed: Aug. 21, 2015

(65) Prior Publication Data

US 2015/0368844 A1 Dec. 24, 2015

Related U.S. Application Data

(62) Division of application No. 13/469,121, filed on May 11, 2012, now Pat. No. 9,115,456.

(60) Provisional application No. 61/577,831, filed on Dec. 20, 2011.

(51) Int. Cl.
*D06F 37/20* (2006.01)
*D06F 33/02* (2006.01)

(52) U.S. Cl.
CPC ..... *D06F 37/203* (2013.01); *D06F 33/02* (2013.01); *D06F 2202/065* (2013.01); *D06F 2202/12* (2013.01); *D06F 2204/065* (2013.01)

(58) Field of Classification Search
CPC ..... D06F 33/02; D06F 2204/065; D06F 2202/12; D06F 2202/065; D06F 37/203
USPC ..... 8/137, 158, 159; 68/12.02, 12.06
See application file for complete search history.

(56) References Cited

U.S. PATENT DOCUMENTS

| | | | | |
|---|---|---|---|---|
| 6,163,912 | A * | 12/2000 | Matsuura | D06F 37/203 68/12.16 |
| 2002/0035757 | A1* | 3/2002 | Ciancimino | D06F 33/02 8/159 |
| 2003/0140427 | A1* | 7/2003 | Yamamoto | D06F 35/007 8/159 |
| 2005/0065662 | A1* | 3/2005 | Reindle | A47L 9/2821 701/1 |
| 2005/0204482 | A1* | 9/2005 | Murray | D06F 33/02 8/158 |
| 2006/0242768 | A1* | 11/2006 | Zhang | D06F 37/203 8/159 |
| 2007/0266504 | A1* | 11/2007 | Xie | D06F 37/203 8/158 |

* cited by examiner

*Primary Examiner* — Michael Barr
*Assistant Examiner* — Benjamin L Osterhout

(57) ABSTRACT

A laundry treating appliance may include a rotatable treating chamber for receiving a laundry load for treatment, and a motor for rotating the treating chamber, and may be operated such that during the acceleration of the laundry load toward a satellizing speed, the satellizing of the laundry load may be detected, whereby subsequent operation of the laundry treating appliance may be controlled based on the detection.

17 Claims, 8 Drawing Sheets

METHOD FOR DETECTING SATELLIZATION SPEED OF CLOTHES LOAD IN A HORIZONTAL AXIS LAUNDRY TREATING APPLIANCE

CROSS REFERENCE TO RELATED APPLICATIONS

The present application represents a divisional application of U.S. patent application Ser. No. 13/469,121 entitled "METHOD FOR DETECTING SATELLIZATION SPEED OF CLOTHES LOAD IN A HORIZONTAL AXIS LAUNDRY TREATING APPLIANCE" filed May 11, 2012, currently allowed. The present application claims the benefit of U.S. Provisional Patent Application No. 61/577,831, filed Dec. 20, 2011, which is incorporated herein by reference in its entirety.

BACKGROUND

Laundry treating appliances, such as clothes washers, may include a perforate rotatable drum or basket positioned within an imperforate tub. The drum may at least partially define a treating chamber in which a laundry load may be received for treatment according to a selected cycle of operation. During at least one phase of the selected cycle, the drum and laundry load may be spun about a rotational axis at a predetermined high speed, sufficient to centrifugally force and hold the laundry load against the perimeter of the treating chamber, causing liquid to be removed from the laundry load. This speed may be referred to as the "satellization" speed.

Known methodologies may provide an estimate of satellization speed based upon a determination of laundry load inertia or mass, or the employment of an iterative process of drum rotation. However, these methods may be inaccurate, or inefficient. It would be advantageous to efficiently determine the satellization speed accurately for a selected laundry load.

BRIEF DESCRIPTION OF THE INVENTION

According to an embodiment of the invention, a method of operating a laundry treating appliance is disclosed. The laundry treating appliance may include a rotatable treating chamber for receiving a laundry load for treatment, and a motor for rotating the treating chamber. The method may include accelerating the rotational speed of the treating chamber from a non-satellizing speed to a satellizing speed by increasing the rotational speed of the motor; generating a first torque signal indicative of the motor torque over time for at least a portion of the accelerating; comparing the shape of the first torque signal to the shape of a second torque signal indicative of rotating the treating chamber when the laundry load is satellized within the treating chamber; and determining the laundry load is satellized when the shape of the first torque signal matches the shape of the second torque signal.

According to another embodiment of the invention, a laundry treating appliance for automatically treating a laundry load according to at least one cycle of operation is disclosed. The laundry treating appliance may include a rotatable treating chamber for receiving the laundry load for treatment; a motor for rotating the treating chamber; a speed sensor outputting a speed signal indicative of the rotational speed of the motor; a torque sensor outputting a torque signal indicative of the torque of the motor; and a controller operably coupled to the motor and receiving the speed signal and torque signal. The controller may provide an acceleration signal to the motor to increase the rotational speed of the motor to accelerate the rotational speed of the treating chamber from a non-satellizing speed to a satellizing speed. The controller may also determine that the treating chamber has reached the satellizing speed by determining when the shape of at least a portion of the torque signal matches a corresponding portion of a reference torque signal, which is indicative of the torque when the laundry load is satellized.

DETAILED DESCRIPTION

Figure 1:
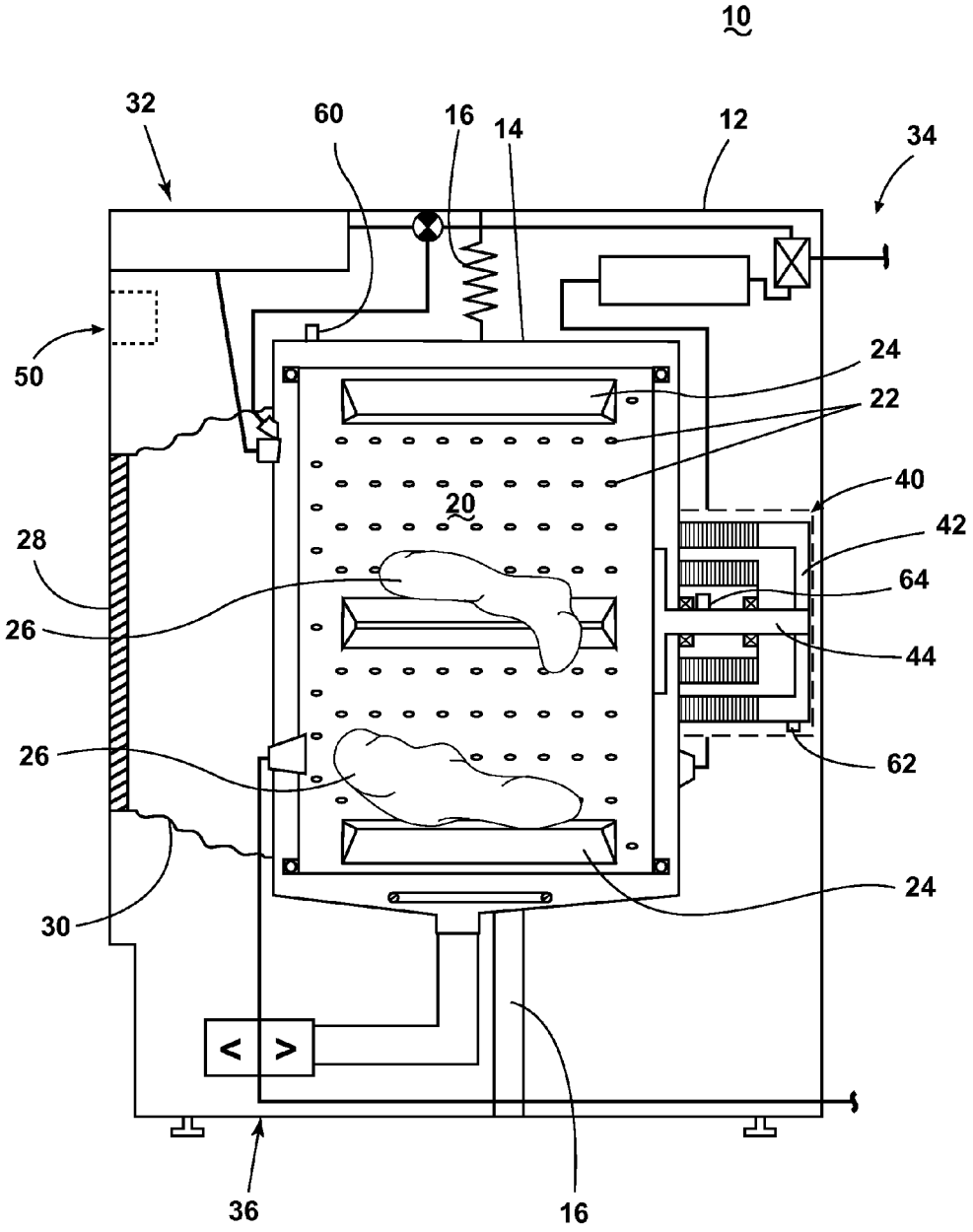
FIG. 1 is a vertical sectional view of a laundry treating appliance in accordance with an exemplary embodiment of the invention.

FIG. 1 is a schematic view of a laundry treating appliance 10 according to an embodiment of the invention. The laundry treating appliance 10 may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine. Exemplary embodiments of the invention will be described herein in the context of a horizontal axis clothes washing machine.

The laundry treating appliance 10 is illustrated in FIG. 1 as including a structural support system comprising a cabinet 12 defining a housing within which a laundry holding system may reside. The cabinet 12 may be a housing having a chassis and/or a frame, defining an interior enclosing components typically found in a conventional washing machine, such as motors, pumps, fluid lines, valves, controls, sensors, transducers, and the like. Such components will not be described further herein except as necessary for a complete understanding of the invention.

The laundry holding system may comprise a tub 14 supported within the cabinet 12 by a suitable suspension system 16, and a drum 18 provided within the tub 14 defining at least a portion of a laundry treating chamber 20. The drum 18 may include a plurality of perforations 22 such that liquid may flow between the tub 14 and the drum 18 through the perforations 22. A plurality of baffles 24 may be disposed on an inner surface of the drum 18 to lift a laundry load 26 received in the treating chamber 20 while the drum 18 rotates. It is also within the scope of the invention for the laundry holding system to comprise only a tub, with the tub defining the laundry treating chamber.

Other known components may include a door 28 which may be movably mounted to the cabinet 12 to selectively close both the tub 14 and the drum 18. A bellows 30 may couple an open face of the tub 14 with the cabinet 12, with the door 28 sealing against the bellows 30 when the door 28 closes the tub 14.

The suspension system 16 may include one or more suspension elements, such as springs, dampers, lifters, cushions, bumpers, and the like, for dynamically suspending the laundry holding system within the structural support system.

The laundry treating appliance 10 may also include a wash aid dispensing system 32, a liquid distribution system 34, a liquid recycling/disposal system 36, and a drum drive system 40, which will be described further only as necessary for a complete understanding of the invention.

The drum drive system 40, for rotating the drum 18 within the tub 14 may include a motor 42, which may be directly coupled with the drum 18 through a drive shaft 44 to rotate the drum 18 about a rotational axis during a cycle of operation. The motor 42 may be a brushless permanent magnet (BPM) motor. Other motors, such as an induction motor or a permanent split capacitor (PSC) motor, may also be used. The motor 42 may rotate the drum 18 at various speeds in either rotational direction.

The laundry treating appliance 10 may include a control system 50 for controlling the operation of the laundry treating appliance 10 to implement one or more cycles of operation. The control system 50 may include a controller 52 located within the cabinet 12 and a user interface 54 that is operably coupled with the controller 52. The user interface 54 may include one or more knobs, dials, switches, displays, touch screens and the like for communicating with the user, such as to receive input and provide output. The user may enter different types of information including, without limitation, cycle selection and cycle parameters, such as cycle options. The controller 52 may control the operation of the laundry treating appliance 10 utilizing a selected motor-control process, such as a closed loop speed control process.

Figure 2:
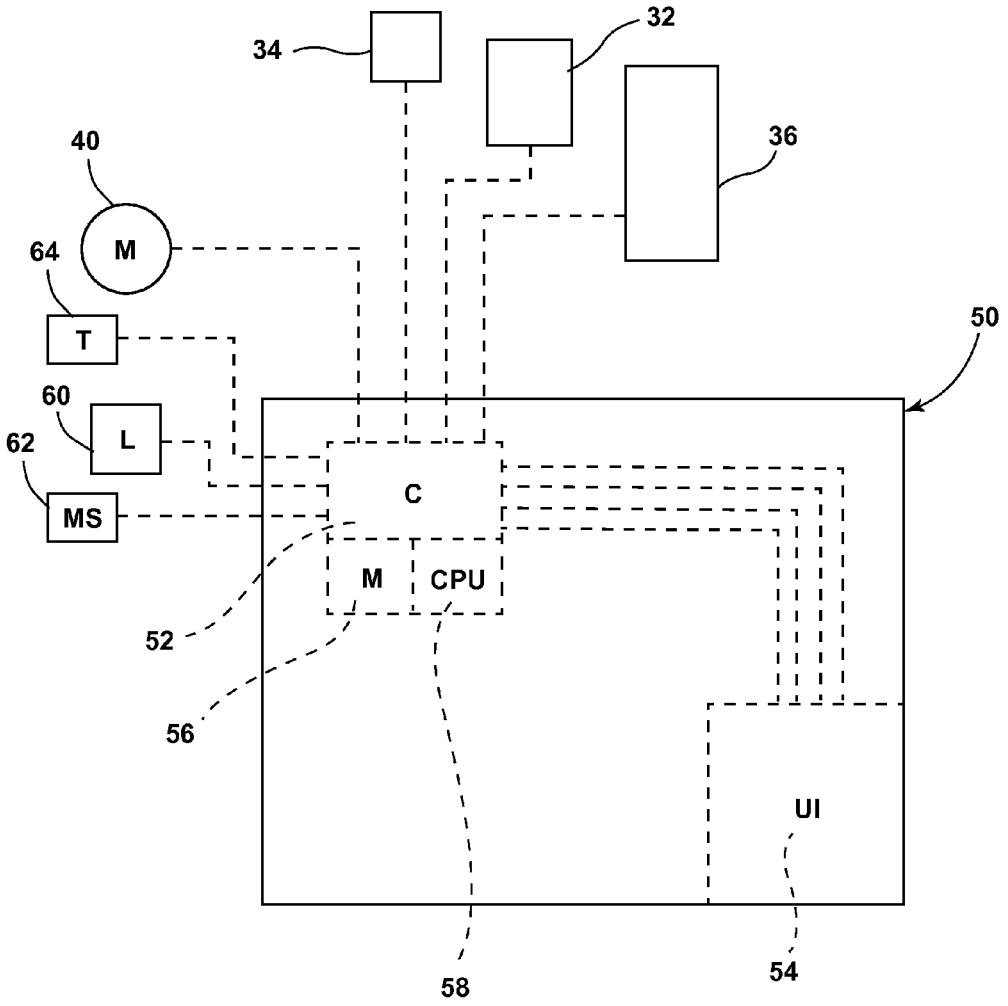
FIG. 2 is a schematic view of a control system comprising a part of the laundry treating appliance illustrated in FIG. 1.

As illustrated in FIG. 2, the controller 52 may be provided with a memory 56 and a central processing unit (CPU) 58. The memory 56 may be used for storing the control software that is executed by the CPU 58 in completing a cycle of operation using the laundry treating appliance 10 and any additional software, plus motor torque signals and reference torque signals. Examples, without limitation, of cycles of operation include: wash, heavy duty wash, delicate wash, quick wash, pre-wash, refresh, rinse only, and timed wash. The memory 56 may also be used to store information, such as a database or table, and to store data received from one or more components of the laundry treating appliance 10 that may be communicably coupled with the controller 52. The database or table may be used to store the various operating parameters for the one or more cycles of operation, including factory default values for the operating parameters and any adjustments to them by the control system or by user input.

The controller 52 may be operably coupled with one or more components of the laundry treating appliance 10 for communicating with and controlling the operation of the components to complete a cycle of operation. For example, the controller 52 may be operably coupled with the wash aid dispensing system 32, the liquid distribution system 34, the liquid recycling/disposal system 36, the drum drive system 40, valves, diverter mechanisms, flow meters, and the like, to control the operation of these and other components to implement one or more of the cycles of operation.

One or more sensors and/or transducers, which are known in the art, may be provided in one or more of the systems of the laundry treating appliance 10, and coupled with the controller 52, which may receive input from the sensors/transducers. Non-limiting examples of sensors that may be communicably coupled with the controller 52 include a treating chamber temperature sensor, a moisture sensor, a load sensor 60, a wash aid sensor, and a position sensor, which may be used to determine a variety of system and laundry characteristics, such as laundry load inertia or mass. Motor speed and motor torque may be represented by outputs provided by the motor 42, or may be provided by a motor speed sensor 62 and motor torque sensor.

A summary of the disclosed method may be described as follows. During a cycle of operation, the drum 18 may be accelerated one or more times to remove liquid from the laundry load 26. During the acceleration of the drum 18, the motor torque may be sampled over each drum revolution and compared to one period of a reference sine wave. A metric may be developed that quantifies a variation in a torque sample buffer relative to the reference sine wave signal. The metric may be devised to be a function of the variation, such that a change in the variation, results in a change in the metric. For simplicity, it is contemplated that an increase in the variation will result in an increase in the metric. The speed at which the laundry load 26 becomes completely satellized may be determined by monitoring the metric for each drum revolution, and comparing it to a preselected threshold metric value. Load satellization may be indicated once the metric drops below the threshold value.

Figures 3A, 3B, 3C:
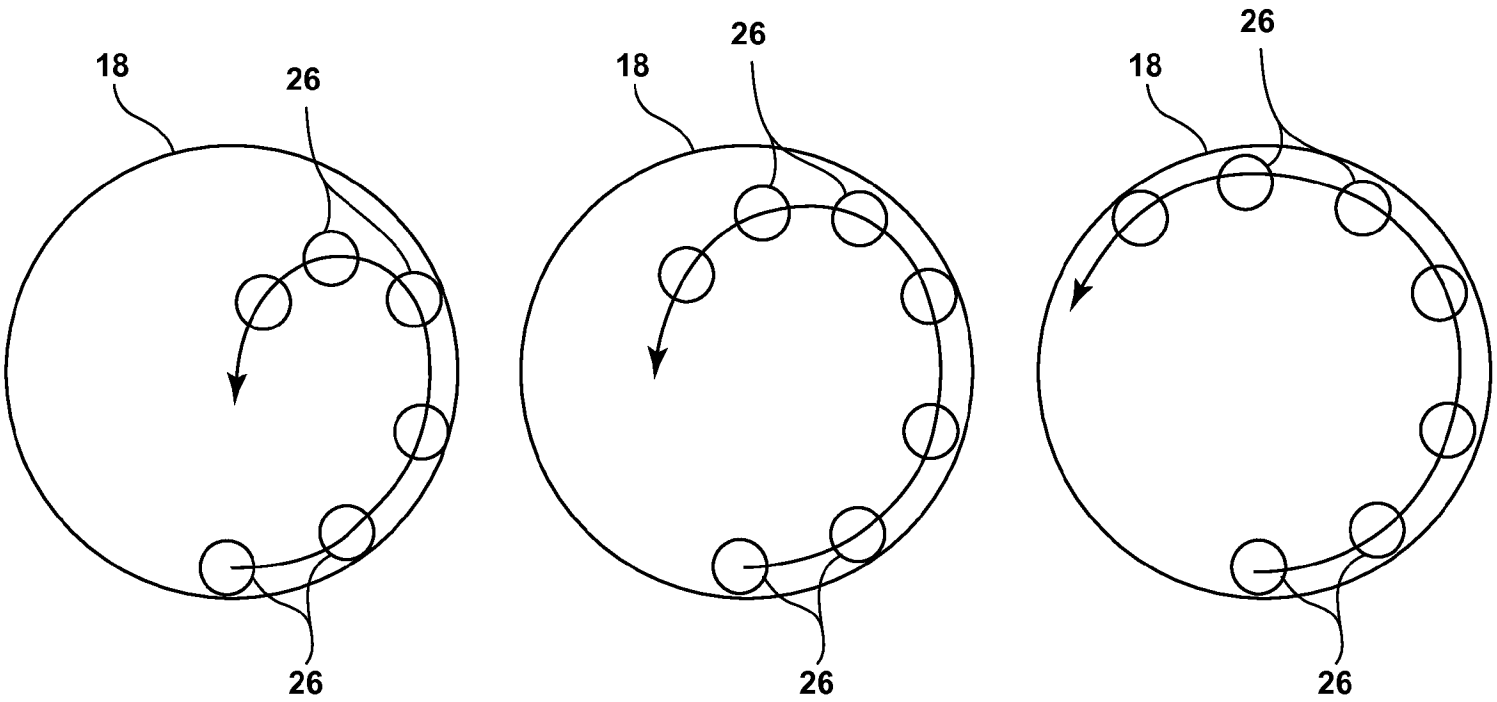
FIGS. 3A-C are schematic views of the rotation of a laundry load in a rotating drum for increasing drum rotation speeds, where the motion of the laundry changes from tumbling (FIG. 3A) to satellized (FIG. 3C).

At drum rotational speeds lower than the satellization speed, as illustrated in FIG. 3A, some or all of the laundry load 26 may be tumbling. At this speed, illustrated in FIG. 4A, the motor torque signal 66 may have high-frequency components 68, 70, 72, 74 effectively superimposed on a generally sinusoidal reference drum frequency signal 76, which may be the result of portions of the laundry load following a trajectory inside the drum 18 that is shorter than one full drum revolution (FIG. 3A). As the rotational speed increases, and a larger percentage of the load is forced against the interior of the drum 18 (FIG. 3B), the torque signal 66 may trend toward a sinusoid, e.g. between the 4th and 6th time interval or drum revolution of FIG. 4A, having a frequency approaching the drum frequency 76, and may have fewer high-frequency components. As the drum speed reaches, and then exceeds, the satellization speed (FIG. 3C), the torque signal 66 may develop into a sine wave having a frequency matching the drum rotational frequency, the magnitude of which may be proportional to the degree of off-balance of the laundry load in the drum 18.

This behavior of the torque signal 66 may be attributed to the orientation of a horizontal axis drum 18, and an interaction between a laundry load 26 and a closed loop speed controller. When the drum 18 is stationary, a wet load may rest on the bottom of the drum 18. A typical speed profile, illustrated in FIG. 4B, utilized to distribute laundry items about the interior of the drum 18 may be a ramp 80 accelerating at a fixed rate from about 40 RPM to about 100 RPM. As the speed increases, the combination of friction and baffles 24 along the interior perimeter of the drum 18 may catch some of the laundry load 26 and lift it up along the side of the drum 18 until portions of the load separate from the drum 18 and drop back to the bottom.

A mass of laundry along the interior perimeter of the drum wall may change the balance of the drum 18, which may cause a somewhat reduced drum speed. In order to track a selected speed profile target as closely as possible, the speed controller may increase the motor torque. When a laundry load portion separates from the drum wall, the speed may increase slightly, leading the controller 52 to call for a reduced torque to appropriately regulate the speed. This repeated variation in torque and/or speed may cause a relatively high-frequency torque ripple that may be observed at rotational speeds less than the satellization speed.

As the selected speed profile continues, the drum 18 accelerates, and through the combined effect of the baffles 24 and drum wall friction, the laundry load may accelerate as well. The uncontrolled process of laundry load portions adhering to and separating from the interior of the drum 18 may continue until the laundry load has achieved a high enough rotational speed that centrifugal force overcomes the force of gravity at the top of the drum 18, and the load remains distributed along the drum wall through a complete revolution of the drum 18. Centrifugal force (CF) is a function of a mass (m) of an object, e.g. a laundry item, an angular velocity (w) of the object, and a distance, or radius (r) at which the object is located with respect to an axis of rotation (X), or a drum axis. Specifically, the equation for the centrifugal force (CF) acting on a laundry item within the drum 18 is:

$$CF=m*\omega^2*r$$

The centrifugal force (CF) acting on any single item in the laundry load may be modeled by the distance the center of gravity of that item is from the axis of rotation (X) of the drum 18. Thus, when the laundry items are stacked upon each other, which is often the case, those items having a center of gravity closer to the axis of rotation (X) experience a smaller magnitude centrifugal force (CF) than those items having a center of gravity farther away. It is possible to control the speed of rotation of the drum 18 such that the closer items will experience a centrifugal force (CF) less than 1 G, permitting them to tumble, while the farther away items still experience a centrifugal force (CF) equal to or greater than 1 G, retaining them in a fixed position relative to the drum 18.

Momentum may also urge the laundry load to travel a complete revolution across the top of the drum 18 at slightly lower speeds than the satellization speed. While some portions of the load may remain against the drum wall, the radius of rotation for other, tumbling portions may decrease. Thus, the tumbling portions must be rotated at a higher speed to overcome gravity. For example, if a 4-inch thick layer of laundry load is distributed about the inside perimeter of the drum 18, the speed required to satellize any tumbling items may be approximately 15 RPMs higher than if the drum 18 were empty.

The following equation may define the torque, T, for a fully satellized laundry load:

$$T=J\dot{\omega}+C\omega+D+A\cos(\theta_{DRUM})+B\sin(\theta_{DRUM}),$$

where

T: Torque,

J: Inertia,

C: Viscous damping coefficient,

D: Coulomb friction torque, $\frac{1}{2}\sqrt{A^2+B^2}$: Unbalance torque amplitude, and $\theta_{DRUM}$: Drum position.

For a fixed speed, viscous damping coefficient, and coulomb friction coefficient, the torque equation may simplify to the following:

$$T=K_1+A\cos(\theta_{DRUM})+B\sin(\theta_{DRUM}),$$

where $K_1=C\omega+D$, $\dot{\omega}=0$, $T=K_1+\sqrt{A^2+B^2}*\sin(\theta_{DRUM}+\pi/4)$, $T=K_1+K_2\sin(\theta_{DRUM}+\phi)$, and $K_2=\sqrt{A^2+B^2}$.

The position of the drum may be a function of time:

$$\theta_{DRUM}=\omega*t.$$

Therefore, the torque may be a function of time:

$$T(t)=K_1+K_2\sin(\omega*t+\phi).$$

As may be recognized, the torque may be a sinusoid with a DC offset $K_1$, amplitude $K_2$, and frequency co, which is equal to the drum frequency in radians per second.

For a constant acceleration, the torque equation may include an additional speed dependency as follows:

$$T=J\dot{\omega}+C\omega+D+K_2\sin(\theta_{DRUM}+\phi),\text{ and}$$

$$T=C\omega+K_1+K_2\sin(\theta_{DRUM}+\phi),$$

where $$K_1=J\dot{\omega}+D.$$

In the case of constant acceleration, the drum speed and drum position are functions of time as follows:

$$\omega(t)=t*RR+\omega(0),$$

where

RR=ramp rate (rad/sec), $\omega(0)$=speed at t=0, $\theta_{DRUM}(t)=\int_0^t\omega(\tau)d\tau$, $\theta_{DRUM}(t)=\int_0^t(\tau*RR+\omega(0))d\tau$, $\theta_{DRUM}(t)=\frac{1}{2}t^2*RR+\omega(0)*t$, and $T(t)=C(t*RR+\omega(0))+K_1+K_2\sin(\frac{1}{2}t^2*RR+\omega(0)*t+\phi)$.

The objective of the algorithm is to detect the speed at which a particular laundry load may become satellized while the drum is accelerating at a constant ramp rate. The fact that the torque signal becomes a sinusoid with a single frequency matching the drum speed at or above satellization speed may be the basis for the algorithm. The algorithm may be based upon determining how much the torque signal differs from one period of a sinusoid for each drum revolution.

The torque signal may be sampled with a fixed sampling rate and stored in a buffer memory. The length of the buffer memory may be sufficient to hold enough sampling data for one complete drum revolution at a lowest speed of interest.

For example, the fixed sampling rate may be 100 Hz, and the lowest drum speed of interest may be 45 RPM. One drum revolution at 45 RPM may take 1.33333 seconds, so sampling every 0.01 second may require 134 samples. Thus, the maximum buffer length required may be 134.

The algorithm may be intended to be implemented in embedded code. Moreover, because the sine function may be unavailable to recall during data sampling, one period of a normalized sine wave may be generated from a fixed number of samples, and stored in memory ahead of time. More sampling data may enable higher resolution, but at the expense of more memory. This array of a fixed number of samples from a normalized sine wave may be referred to as a "reference signal," and may be expressed as follows:

$$Ref(n) = \sin\left(2\pi * \frac{n}{L}\right),$$

where $n \in \{0, 1, 2, 3, \ldots L-1\}$, and

L=length of reference array.

The length of the reference array may be at least twice the length of the torque buffer array to assure sufficiently high resolution when selecting the samples from the reference array to compare to each sample in the torque array.

The torque signal from the equation for T(t), above, may be in continuous time, and the process of sampling with a fixed sampling period, $T_s$, may have the following effect on the equation:

$$t=k*T_s,$$

where $k \in \{0, 1, 2, 3, \ldots L-1\}$, and $T(kT_s)=C(kT_s*RR+\omega(0))+K_1+K_2 \sin G(\tfrac{1}{2}(kT_s)^2*RR+\omega(0)*kT_s+\phi)$.

For low speeds, the viscous damping coefficient may be very small, and over one period of the sine wave, $(kT_s*RR)$ may be a small number, so that the expression $C(kT_s*RR+\omega(0))$ may be simplified to $(C*\omega(0))$. This term may be grouped with $K_1$ so that the equation may simplify to the following:

$$T(kT_s)=\delta+K_2 \sin((kT_s*RR+\omega(0))*kT_s+\phi),$$

where $\delta=C*\omega(0)+K_1$.

In order to compare the torque signal to the reference signal there are 3 characteristics of the sampled torque signal that are useful to determine: a constant offset ($\delta$), an amplitude ($K_2$), and a phase ($\phi$). If these 3 parameters are determined, the reference signal may be scaled by $K_2$, biased by $\delta$, and shifted by $\phi$. In the following example, $\delta=1$, $K_2=4$, and $\phi=\pi/4$.

Figure 5A:
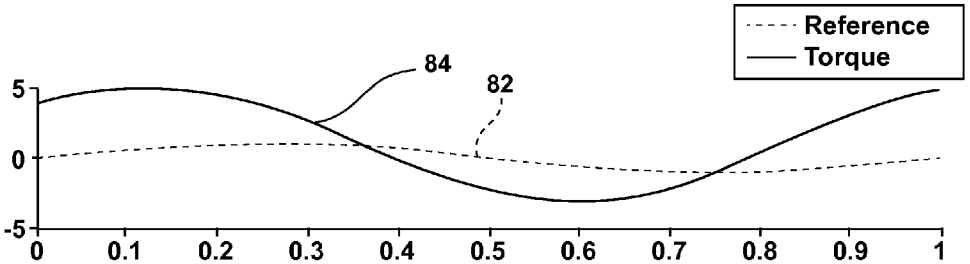
FIGS. 5A-C are graphical representations of a reference torque curve and an actual torque curve in raw form, in reference, scaled, and biased form, and in reference, scaled, biased, and shifted form.
Figure 5B:
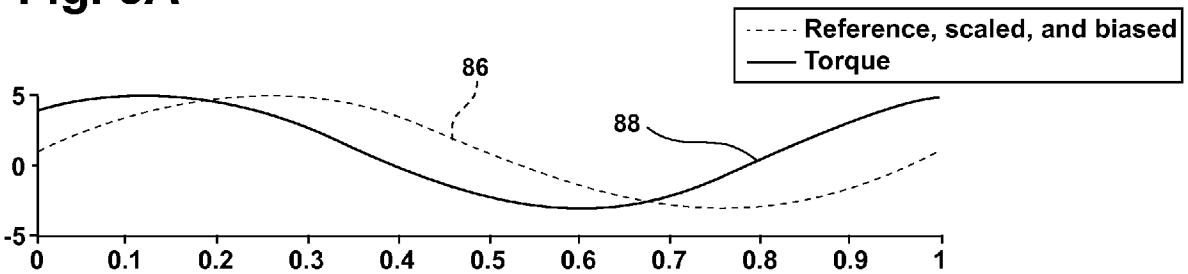
Figure 5C:
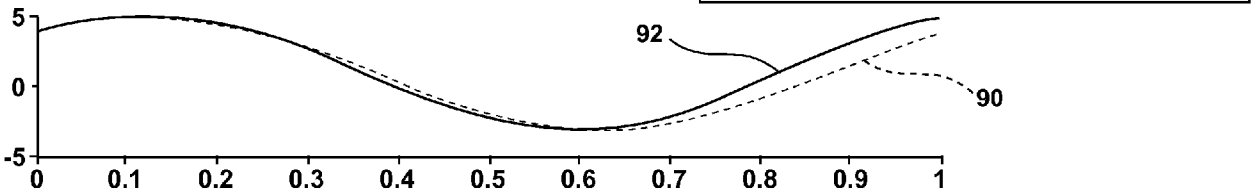

FIG. 5A illustrates a raw reference signal 82 and a torque signal 84. FIG. 5B illustrates a scaled and biased reference signal 86 and a torque signal 88. FIG. 5C illustrates a scaled, biased, and shifted reference signal 90 and a torque signal 92.

FIG. 5C illustrates the torque signal 92 initially matching the reference signal 90 well, but as time progresses, the torque signal 92 may lead the reference signal 90. This is the result of the torque sine wave frequency increasing at a constant rate as the drum speed increases at a constant rate. In this example, the ramp rate is 5 RPM per second (0.0833 Hz/s), and at the end of the cycle, the torque signal frequency is about 8% higher than the reference signal.

To account for an increasing frequency of the torque signal, the sampling data from the reference array may be selected at an increasing time interval. To determine the correct relationship, the expressions for the torque and reference array may be equated, and solved for the reference array sample, n. (For the derivation, the phase, $\phi$, may be set to 0, and the ramp rate, RR, and initial speed, $\omega(0)$, may be converted to Hz/s and Hz, respectively.) Thus:

$$\left[Ref(n) = \delta + K_2 \sin\left(2\pi * \frac{n}{L}\right)\right] = \left[T(kT_s) = \delta + K_2 \sin\left(2\pi * \left(\frac{1}{2}(kT_s)^2 * RR + \omega(0) * kT_s\right)\right)\right],$$

$$\left[\delta + K_2 \sin\left(2\pi * \frac{n}{L}\right)\right] = \left[\delta + K_2 \sin\left(2\pi * \left(\frac{1}{2}(kT_s)^2 * RR + \omega(0) * kT_s\right)\right)\right],$$

$$\left(\frac{n}{L}\right) = \left(\frac{1}{2}(kT_s)^2 * RR + \omega(0) * kT_s\right), \text{ and}$$

$$n = \left(\frac{1}{2}(kT_s)^2 * RR + \omega(0) * kT_s\right) * L.$$

Figure 6A:
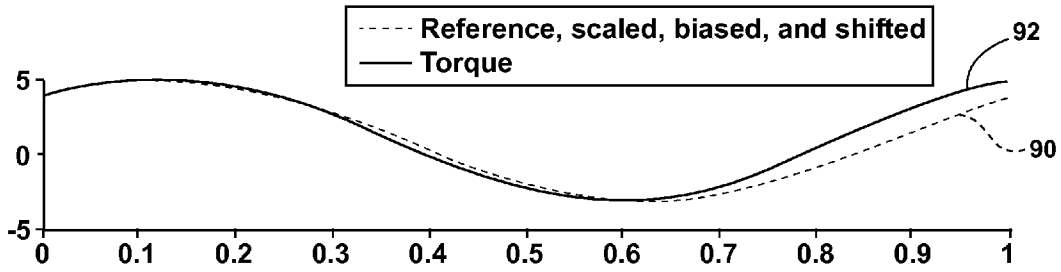
FIGS. 6A-C are graphical representations of a reference torque curve and an actual torque curve in reference, scaled, biased, and shifted form, in reference, scaled, biased, shifted, and frequency adjusted form based upon 100 data samples per cycle, and in reference, scaled, biased, shifted, and frequency adjusted form based upon 200 data samples per cycle.
Figure 6B:
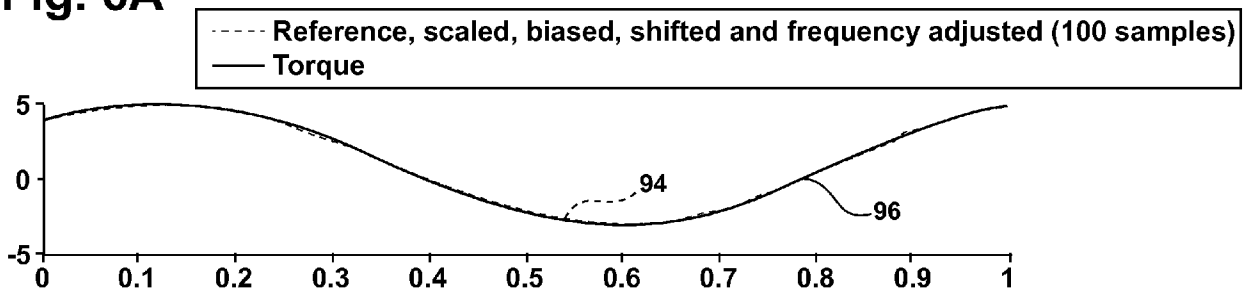
Figure 6C:
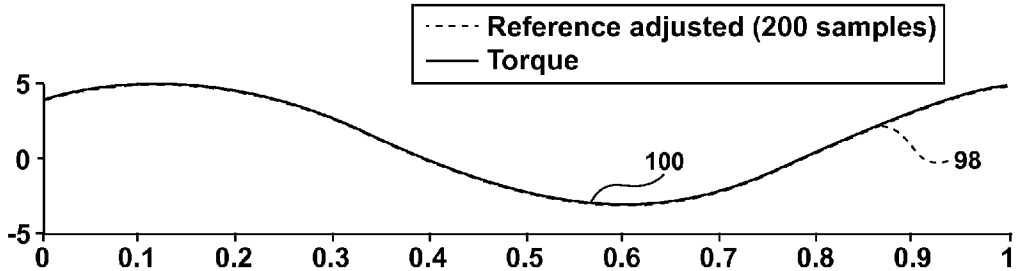

Finally, by implementing the above equation for n and select sampling data from the reference array, we may observe how the torque and reference signals line up. FIG. 6A illustrates the sampled torque signal 92 and the scaled, biased, and shifted reference signal 90 shown in FIG. 5C. FIG. 6B illustrates the sampled torque signal 96 and the scaled, biased, shifted, and frequency-adjusted reference signal 94 with a 100 point reference sampling array. FIG. 6C illustrates the same signal correlation as illustrated in FIG. 6B, but with a 200 point reference sampling array. The effect of utilizing more samples in the reference array may be observed from FIGS. 6B and 6C.

The above equation for n may enable a comparison of the torque signal to the reference signal for any combination of starting speeds and ramp rates. For example, if the ramp rate were 0, and the starting speed were 60 RPM (1 Hz):

$$n=(\tfrac{1}{2}(kT_s)^2*RR+\omega(0)*kT_s)*L,$$

$$n=(1*kT_s)*L$$

If the reference array length were 400, and the sampling period, $T_s$ were 0.01, then:

$$n = k\left(\frac{1}{100}\right) * 400,$$

$$n = 4k$$

Figure 7A:
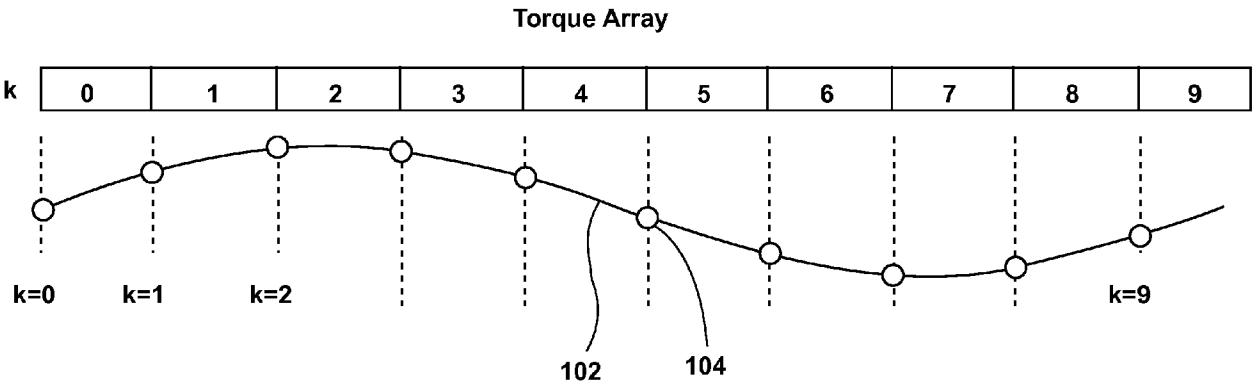
FIGS. 7A-B are graphical representations of an array of data points representing actual torque and an array of reference torque data points twice the number of the actual torque data points.
Figure 7B:
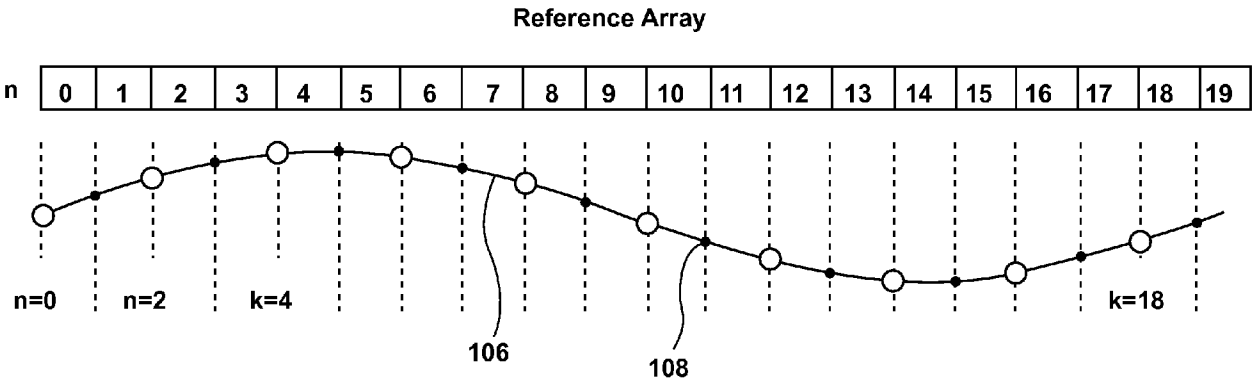

An actual comparison may be accomplished by iterating through the entire torque array buffer, and comparing each sample to the appropriate sample from the reference array using the equation:

$$n=(\tfrac{1}{2}(kT_s)^2*RR+\omega(0)*kT_s)*L.$$

determine the reference sample size. For example, with a torque sampling period=0.1 second, and a length of the reference array=20, then n=2 k. This is illustrated in FIGS. 7A and 7B, wherein values of k and n, respectively, may be correlated. FIG. 7A illustrates that every data point 104 on the torque array 102 may be utilized. FIG. 7B illustrates that every other element 108 from the reference array 106 may be ignored.

As a loop through the array from k=0 to k=N−1 progresses, a magnitude of the difference between the two points, i.e. torque array data point 104 and reference array element 108, may be calculated:

$$\sqrt[2]{(T(k)-\mathrm{Ref}(n))^2},$$

where $k \in \{0, 1, 2, 3, \ldots N-1\}$, $n=(\frac{1}{2})(kT_s)^2*RR+\omega(0)*kT_s)*L$, $\mathrm{Metric}=\Sigma_{k=0}^{N-1}\sqrt[2]{(T(k)-\mathrm{Ref}(n))^2}$, and $n=(\frac{1}{2}(kT_s)^2*RR+\omega(0)*kT_s)*L$.

The magnitude of the difference at each point may be summed for the entire array, then divided by the length of the torque buffer array. As an example, assuming each point in the array differs by 1, and the length of the torque array is 100, then Metric=1.

Figure 4A:
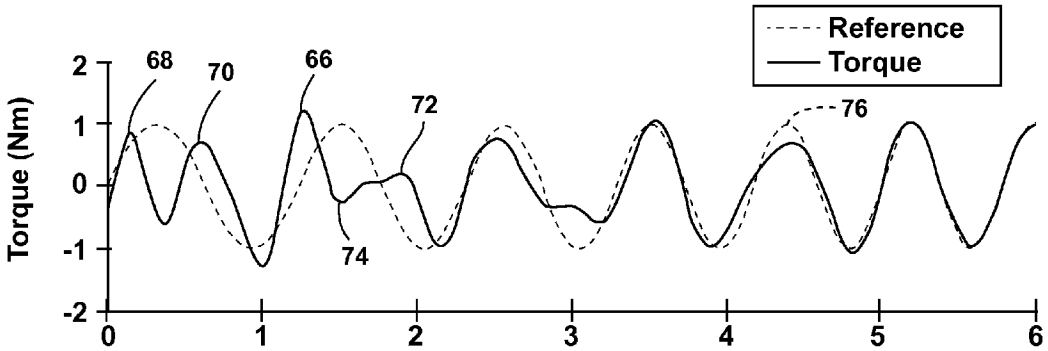
FIGS. 4A-B are graphical representations of a sinusoidal reference torque curve and an actual torque curve for a rotating laundry load at an increasing drum rotation speed.
Figure 4B:
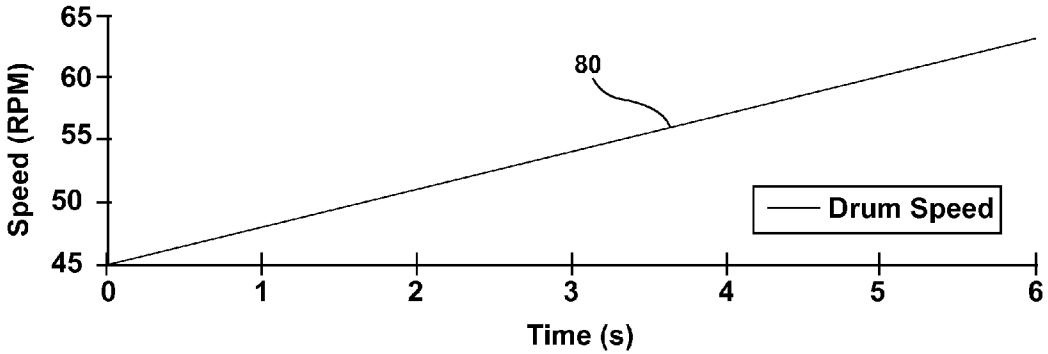
Figure 8A:
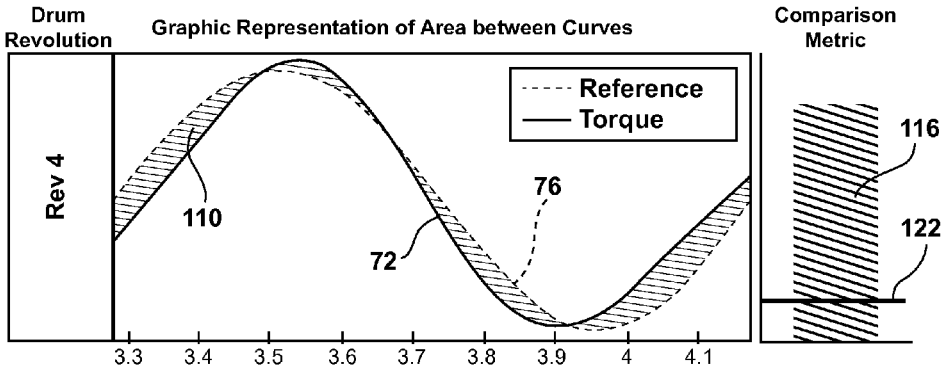
FIGS. 8A-C are graphical representations of a reference torque curve and an actual torque curve generated during an exemplary $4^{th}$ drum revolution (FIG. 8A), an exemplary $5^{th}$ drum revolution (FIG. 8B), and an exemplary $6^{th}$ drum revolution (FIG. 8C), illustrating a comparison metric that decreases to a value below a threshold value as the reference torque curve and actual torque curve become coincidental.
Figure 8B:
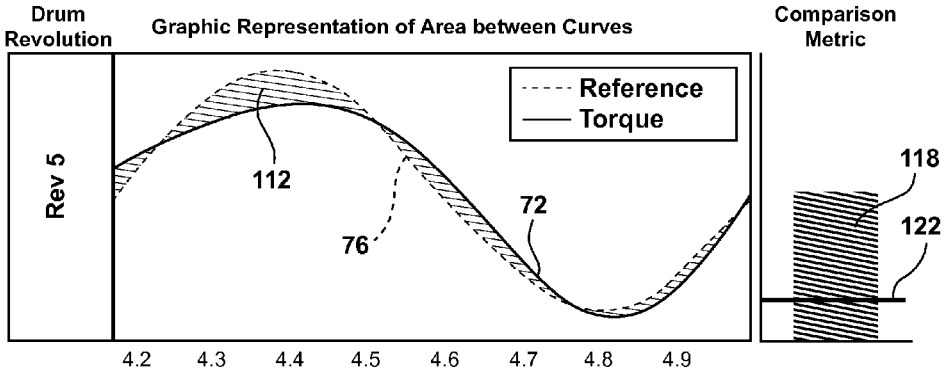
Figure 8C:
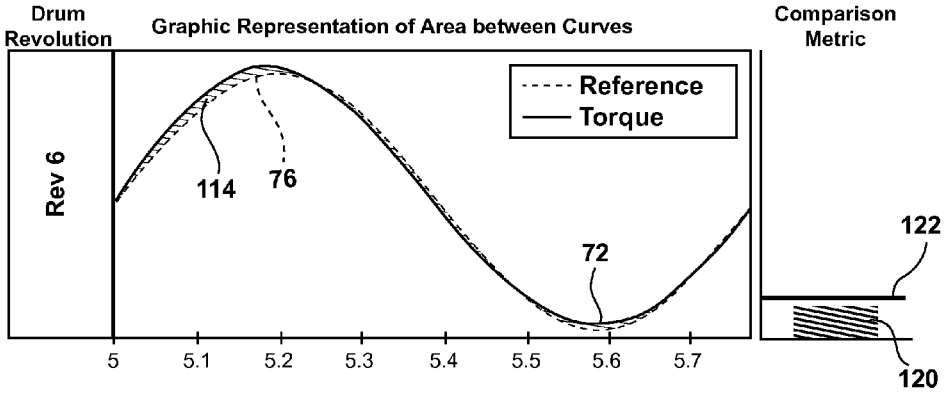

FIGS. 8A, 8B, and 8C illustrate additional analyses of the drum revolutions 4, 5, and 6, respectively, illustrated in FIG. 4A. The shaded area 110, 112, 114 in each figure may essentially represent the metric. In FIG. 8A, for example, the shaded area 110, i.e. the degree to which the torque curve 72 deviates from the reference curve 76, is also represented by a bar graph 116. An empirical threshold value 122 established for a selected laundry treating appliance running a selected cycle of operation for a selected laundry load is also represented with the bar graph 116.

As the laundry load becomes satellized, the area 110, 112, 114 between the curves may be reduced, and the associated metric 116, 118, 120 may reflect this reduction, as illustrated in FIGS. 8A, 8B, and 8C. When the metric 120, i.e. the difference between the torque curve and the reference curve, decreases to a value less than the empirical threshold value 122, as illustrated in FIG. 8C, the laundry load may be said to be satellized. For example, in FIG. 8C, after completing revolution 6, the metric 120 is less than the threshold value 122, and the laundry load is therefore satellized. FIG. 8C indicates a satellization speed of approximately 60 RPM.

Selected equal-length intervals, or "windows," of time may be established, and a torque signal may be generated for each selected interval. Data associated with each interval may be collected and evaluated. The intervals may advance forward in time as acceleration proceeds and satellization develops. The metric, or difference between the torque signal and the reference torque signal, may be determined as a difference in the amplitudes of the torque and reference torque signals. Alternatively, the difference between the signals may be the difference between a running average of the amplitudes of the torque signal and the reference signal. The running average may be a moving running average, which may be determined from a window of data points of fixed length advancing in time.

The embodiment of the invention described herein provides a method for readily determining a satellization speed for a selected laundry treating appliance running a selected cycle of operation for a selected laundry load. Thus, the satellization speed can be efficiently reached for effective liquid extraction while minimizing vibration and energy usage.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A fabric treating appliance for automatically treating a laundry load according to at least one cycle of operation, comprising:

a rotatable treating chamber for receiving the laundry load for treatment;

a motor for rotating the treating chamber;

a speed sensor outputting a speed signal indicative of a rotational speed of the motor;

a torque sensor outputting a torque signal indicative of a torque of the motor;

a controller operably coupled to the motor and receiving the speed signal and torque signal, wherein the controller provides an acceleration signal to the motor to increase the rotational speed of the motor to accelerate the rotational speed of the treating chamber from a non-satellizing speed to a satellizing speed, and determines that the treating chamber has reached the satellizing speed by determining when a shape of at least a portion of the torque signal matches a corresponding portion of a reference torque signal, which is indicative of the torque when the laundry load is satellized; and wherein the controller provides the acceleration signal to the motor to increase the rotational speed of the motor at a predetermined rate.

2. The fabric treating appliance of claim 1 wherein the predetermined rate is constant.

3. The fabric treating appliance of claim 1 further comprising a tub defining an interior and a rotatable drum located within the interior, with the drum defining the treating chamber, where the portion of the torque signal is generated during a corresponding portion of the acceleration of the motor.

4. The fabric treating appliance of claim 3 where the portion of motor acceleration is one of a predetermined window of time and a predetermined number of degrees of drum rotation.

5. The fabric treating appliance of claim 4 wherein the predetermined window of time is fixed in width and advances forward in time.

6. The fabric treating appliance of claim 1 further comprising a tub defining an interior and a rotatable drum located within the interior, with the drum defining the treating chamber, wherein the reference torque signal is selected from a set of reference torque signals differentiated by an acceleration rate and a drum speed.

7. The fabric treating appliance of claim 1 further comprising a tub defining an interior and a rotatable drum located within the interior, with the drum defining the treating chamber, where the rotational speed of the motor corresponds to a rotational speed of the drum.

8. A fabric treating appliance for automatically treating a laundry load according to at least one cycle of operation, comprising:

a rotatable treating chamber for receiving the laundry load for treatment;

a motor for rotating the treating chamber;

a speed sensor outputting a speed signal indicative of a rotational speed of the motor;

a torque sensor outputting a torque signal indicative of a torque of the motor;

a controller operably coupled to the motor and receiving the speed signal and torque signal, wherein the controller provides an acceleration signal to the motor to increase the rotational speed of the motor to accelerate the rotational speed of the treating chamber from a non-satellizing speed to a satellizing speed, and determines that the treating chamber has reached the satellizing speed by determining when a shape of at least a portion of the torque signal matches a corresponding portion of a reference torque signal, which is indicative of the torque when the laundry load is satellized; and wherein the controller determines a difference between the shape of the portion of the torque signal and the corresponding portion of the reference torque signal.

9. The fabric treating appliance of claim 8 where the controller determines the laundry load is satellized when the difference satisfies a reference value.

10. The fabric treating appliance of claim 9 wherein the reference value is a threshold value.

11. The fabric treating appliance of claim 8 wherein the difference comprises the difference in an amplitude of the torque signal and an amplitude of the reference torque signal.

12. The fabric treating appliance of claim 11 wherein the difference comprises the difference between a running average of the amplitude of the torque signal and a running average of the amplitude of the reference torque signal.

13. The fabric treating appliance of claim 12 wherein the running average is a moving running average.

14. The fabric treating appliance of claim 13 wherein the moving running average is determined from a window of data points of fixed length advancing in time.

15. A fabric treating appliance for automatically treating a laundry load according to at least one cycle of operation, comprising:

a rotatable treating chamber for receiving the laundry load for treatment;

a motor for rotating the treating chamber;

a speed sensor outputting a speed signal indicative of a rotational speed of the motor;

a torque sensor outputting a torque signal indicative of a torque of the motor;

a controller operably coupled to the motor and receiving the speed signal and torque signal, wherein the controller provides an acceleration signal to the motor to increase the rotational speed of the motor to accelerate the rotational speed of the treating chamber from a non-satellizing speed to a satellizing speed, and determines that the treating chamber has reached the satellizing speed by determining when a shape of at least a portion of the torque signal matches a corresponding portion of a reference torque signal, which is indicative of the torque when the laundry load is satellized; and wherein a portion of the motor rotation corresponds to a portion of the treating chamber rotation.

16. A fabric treating appliance for automatically treating a laundry load according to at least one cycle of operation, comprising:

a rotatable treating chamber for receiving the laundry load for treatment;

a motor for rotating the treating chamber;

a speed sensor outputting a speed signal indicative of a rotational speed of the motor;

a torque sensor outputting a torque signal indicative of a torque of the motor;

a controller operably coupled to the motor and receiving the speed signal and torque signal, wherein the controller provides an acceleration signal to the motor to increase the rotational speed of the motor to accelerate the rotational speed of the treating chamber from a non-satellizing speed to a satellizing speed, and determines that the treating chamber has reached the satellizing speed by determining when a shape of at least a portion of the torque signal matches a corresponding portion of a reference torque signal, which is indicative of the torque when the laundry load is satellized; and wherein a predetermined number of degrees of motor rotation corresponds to a predetermined number of degrees of treating chamber rotation.

17. A fabric treating appliance for automatically treating a laundry load according to at least one cycle of operation, comprising:

a rotatable treating chamber for receiving the laundry load for treatment;

a motor for rotating the treating chamber;

a speed sensor outputting a speed signal indicative of a rotational speed of the motor;

a torque sensor outputting a torque signal indicative of a torque of the motor;

a controller operably coupled to the motor and receiving the speed signal and torque signal, wherein the controller provides an acceleration signal to the motor to increase the rotational speed of the motor to accelerate the rotational speed of the treating chamber from a non-satellizing speed to a satellizing speed, and determines that the treating chamber has reached the satellizing speed by determining when a shape of at least a portion of the torque signal matches a corresponding portion of a reference torque signal, which is indicative of the torque when the laundry load is satellized; and wherein the rotational speed of the motor corresponds to the rotational speed of the treating chamber.

* * * * *